US006729767B2

(12) United States Patent
Schuller et al.

(10) Patent No.: US 6,729,767 B2
(45) Date of Patent: May 4, 2004

(54) STEP BEARING FOR AXIAL SUPPORT OF AN OPEN-END SPINNING ROTOR

(75) Inventors: Edmund Schuller, Ingolstadt (DE); Manfred Knabel, Ingolstadt (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 10/231,596

(22) Filed: Aug. 30, 2002

(65) Prior Publication Data

US 2003/0068107 A1 Apr. 10, 2003

(30) Foreign Application Priority Data

Sep. 4, 2001 (DE) ..... 101 43 288

(51) Int. Cl.[7] ..... F16C 19/12; D01H 4/12

(52) U.S. Cl. ..... 384/420; 384/121; 384/549; 57/406

(58) Field of Search ..... 384/549, 420, 384/121; 57/404, 406

(56) References Cited

U.S. PATENT DOCUMENTS 4,703,616 A 11/1987 Feuchter et al.
4,763,469 A * 8/1988 Stahlecker et al. ..... 57/407
5,098,205 A 3/1992 Zehndbauer et al.
5,450,718 A * 9/1995 Knabel et al. ..... 384/121
5,791,786 A 8/1998 Stahlecker
5,927,869 A 7/1999 Zott
6,032,452 A 3/2000 Zott
6,401,444 B1 * 6/2002 Knabel et al. ..... 384/121

FOREIGN PATENT DOCUMENTS

DE 4022562 A1 1/1992
DE 19542908 A1 * 5/1997

OTHER PUBLICATIONS

German Search Report dated Apr. 25, 2002.

* cited by examiner

*Primary Examiner*—Thomas R. Hannon
(74) *Attorney, Agent, or Firm*—Dority & Manning, P.A.

(57) ABSTRACT

To improve the known step bearings for the support of open-end spinning rotors, it is proposed to design the bearing body with a machine-side support and a rest for the spinning rotor. According to the invention, a flat bearing surface constituting one end of the bearing body is provided as the rest for the spinning rotor. The flat bearing surface is preferably designed as a bearing plate of an aerostatic step bearing capable of being subjected to compressed air.

10 Claims, 2 Drawing Sheets

STEP BEARING FOR AXIAL SUPPORT OF AN OPEN-END SPINNING ROTOR

BACKGROUND OF THE INVENTION

The present invention relates to a step bearing for axial support of an open-end spinning rotor in a spinning device of an open-end spinning machine. To support open-end spinning rotors, it is a known method to receive them in the nip of bearing disk pairs for radial support, whereby drive means or some other axial thrust having to be supported by an axial bearing is forced on them by the radial support. Open-end spinning rotors are provided with a shaft at the one end of which the rotor pot is mounted, within which fibers are fed pneumatically and are spun in to a yarn. At the end across from the rotor pot, the rotor shaft is supported axially in an axial bearing. Different embodiments of axial bearings for this are known in the state of the art.

EP 0435016 B1 shows an aerostatic axial bearing in which the rotor shaft bears upon a bearing plate subjected to compressed air. DE 19542908 A1 discloses an axial bearing for a rotor shaft in which the rotor shaft bears axially upon a ball that rotates together with the rotor shaft. Axial bearings in which the rotor shaft bears upon a ball that also rotates have been the preferred type of axial support of spinning rotors in the past. Such a support is shown, e.g., in DE 3533717 A1 as well as in DE 19652507 A1. The latter patent shows the replaceable ball located in a chamber filled with grease. In the axial support of the rotor shaft described in DE 19542908, a modified embodiment is shown in which the ball in turn bears upon additional balls and the balls are contained in a housing.

It is a disadvantage of the known axial bearings of spinning rotors that in part their assembly is awkward and time consuming, or that the axial bearing can become loose or can be difficult to adjust because it is installed directly on the machine frame, whereby the bearing is held perpendicularly to the direction of stress. A further disadvantage of axial bearings using a ball is that existing spinning devices can no longer operate economically because such axial bearings require a shaft end that extends clearly past the plane of the supporting disks, so that the rotor speed cannot be further increased because of the length of the rotor shaft, as otherwise inadmissible oscillations would occur. These oscillations can even result in a failure of the bearing.

OBJECTS AND SUMMARY OF THE INVENTION

It is therefore a principal object of the present invention to propose a new step bearing that is simple in construction, easy to assemble, easy to replace and that furthermore makes it possible to modernize open-end spinning devices in a simple manner, since they can now be operated with spinning rotors at speeds that may be considerably higher. Additional objects and advantages of the invention will be set forth in part in the following description, or may be obvious from the description, or may be learned through practice of the invention.

This principal object is attained according to the invention through a step bearing for the axial support of an open-end spinning rotor in a spinning device of an open-end spinning machine, with a bearing body provided with a rest for the spinning rotor and a support on the machine side. The rest is made in the form of a flat bearing surface constituting the one end of the bearing body, while the other end of the bearing body is made as a supporting surface of the machine-side support. By using the step bearing of the present invention, the bearing can be made to be easily replaceable, since only the air arrival hose for the supply of compressed air to the bearing surface need be disassembled, while the rest of the support on the machine can remain essentially unchanged. According to the present invention, it is even possible to use an adjusting screw as in known axial ball bearings as a support on the machine with an axial bearing.

In addition, the bearing according to the invention has the added advantage that, with this bearing open-end spinning devices according to the state of the art can be refitted easily from an axial ball bearing to an aerostatic axial bearing. A refitting to another axial bearing can be achieved thereby. Beyond this, it is possible, to change the geometry of the axial bearing or the open-end spinning device thanks to the utilization of a step bearing according to the invention. Changing the geometry of the axial bearing or the open-end spinning device allows the shaft of the spinning rotor to be made considerably shorter and the supporting surface can be located directly at the end of the bearing body. As a result, it is possible to increase the rotor speeds significantly, since now rotor shafts can be used that are considerably shorter. At the same time it is even possible to use the previously used axial support on the machine, since the bearing according to the invention can also bear upon the known supports for the ball of an axial ball bearing.

In an especially advantageous further development of the invention, the flat bearing surface of the bearing according to the invention is made in the form of a bearing plate that can be subjected to compressed air, so that the step bearing advantageously becomes an aerostatic step bearing by means of which open-end spinning rotors can be securely supported with little need for maintenance. For this purpose, the bearing plate of the step bearing according to the invention is advantageously provided with bores for the passage of compressed air or with a bearing plate that is permeable, i.e., through which compressed air flows from the back into the bearing gap where it constitutes a compressed-air cushion on which the rotor shaft bears.

In an advantageous further development, the bearing body is provided with a connection for compressed air, whereby the connection is placed essentially at a right angle to the axis of the bearing body, and thus also at a right angle to the axis of the rotor shaft interacting with the step bearing. This makes it possible for the one end of the bearing body to be used in its entirety as a bearing surface for the support on the side of the machine, without space being required to integrate a compressed-air connection in this area. In addition, such a placement of the compressed-air connection has the advantage of being able to use existing components of machines to be retrofitted, in particular the axial support on the machine. Also, such a placement of the compressed-air connection creates room for the compressed-air connection of an aerostatic axial bearing, either because no or only few rebuilding measures are needed. In an especially advantageous further development of the invention, the bearing surface of the step bearing is designed for the support on the machine in such manner that it can be used with an already existing bearing device, e.g., for a ball. For this, the bearing surface advantageously can be provided with reinforcement on the bearing body. This reinforcement makes it possible to also use a bearing body made of plastic which can then interact with a support on the machine that has not been produced especially for a step bearing according to the invention. Most advantageously, this reinforcement makes it possible for the bearing body to be formed economically from a plastic while nevertheless possessing sufficient mechanical strength. In a further development of the invention the bearing plate is superimposed axially over the bearing body. This axial placement of the bearing plate over the bearing body is especially advantageous for the installation of the bearing plate on the bearing body, making it possible to design an especially short rotor shaft because, in that way, the bearing plate can be located especially close to the pair of supporting rollers across from it.

The bearing plate is most advantageously designed as a non-replaceable bearing plate on the bearing body, ensuring that the bearing plate can be integrated solidly in the bearing body. In addition, this advantageous configuration of the bearing plate allows the bearing plate to be combined most securely with the bearing body. This secure combination can be achieved advantageously, e.g., by bonding it into the base body or by pressing it into the base body. In an advantageous further development of the invention, the bearing body is at least in part cylindrical and on its circumference a bearing surface is formed to hold the bearing body in circumferential direction. This cylindrical design makes it possible to prevent a twisting of the bearing body through simple design of the seat in the spinning device.

In another advantageous further development of the invention, the bearing body is provided with a cylindrical form on its side towards the spinning rotor and with an angular cross-section on its side towards the support on the machine. Such a construction allows the bearing body to be held by simple means in its position in the open-end spinning machine, since an angular cross-section provides surfaces on which means to fix or to position it can be applied.

Additional advantageous further developments of the invention are found in the description of examples of embodiments. The invention is described below through drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
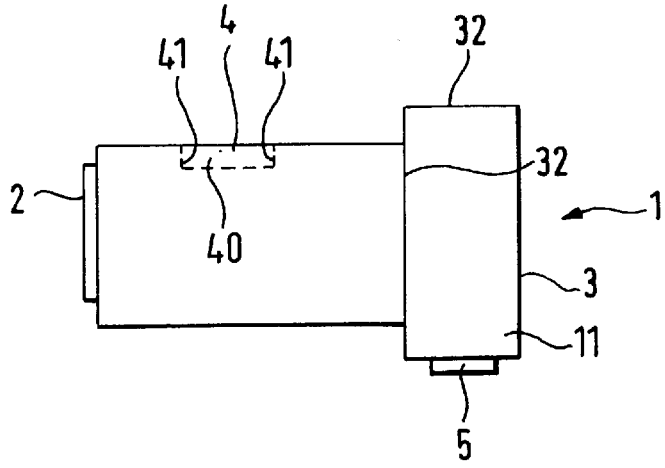
FIG. 1 shows a step bearing according to the invention, in a side view.

FIG. 1 shows a step bearing 1 with its bearing body 11 as well as with a bearing surface 2 and with a supporting surface 3 formed at the other end of the bearing body 11, parallel to the bearing surface 2. The force applied by the spinning rotor via its shaft 81 upon the bearing body 11 bears via supporting surface 3 upon the spinning machine (see FIG. 4).

Figure 2:
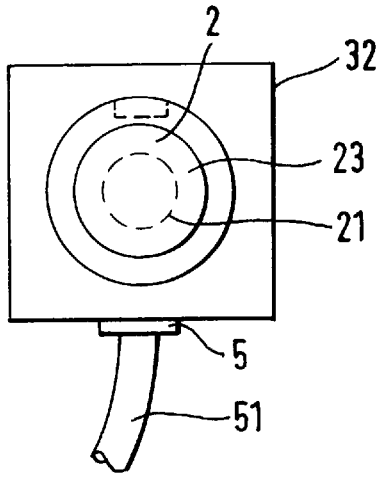
FIG. 2 shows the step bearing of FIG. 1 from the side with the bearing plate.

The bearing body 11 is in part made with a round cross-section, this in the area of the bearing surface 2, and in part with an angular cross-section in the area of the supporting surface 3, as is made clear by the edge 32 in FIG. 1 as well as in FIG. 2. In the area of the cylindrical portion of the bearing body 11 is a supporting surface 4, whereby this supporting surface 4 is provided by a groove 40 in the circumferential wall of the bearing body 11. Thus, each of the two sides of groove 40 constitutes a supporting surface 4. The two supporting surfaces 4 (see FIG. 3) make it possible to prevent in a simple manner, for example, the rotation of the bearing body 11 together with the rotor shaft that presses against it.

In addition, it is, however, also possible to design an axially acting stop that is then realized by the two walls 41 perpendicular to the supporting surface 4. With this design having a groove 40 it is possible in a simple manner to realize a fixing of the bearing body 11 in a desired position, e.g., by means of a mandrel entering the groove 40. On its side across from the groove 40, the bearing body 11 is provided with a compressed-air connection 5 to which a compressed-air hose 51 (see FIGS. 2 and 4) is connected during the operation of the step bearing. Inside the bearing body 11, one or several conduits go from the compressed-air connection 5 to the bearing surface 2 where the air emerges into the bearing gap.

FIG. 2 shows the bearing surface 2 with bores 21 for the exit of air from the bearing surface 2. The flat bearing surface 2 is made in the form of a bearing plate 23 of an aerostatic step bearing capable of being subjected to compressed air. The bores 21 are essentially arranged in a circle around the center of the bearing plate 23. The bearing plate 23 is pressed into the bearing body 11 or into a bore of the bearing body 11. In the drawing of FIG. 2, the compressed-air connection 5 can also be recognized, together with a compressed-air hose 51 connected to it. From FIG. 2, it also clearly appears that a portion of the bearing body 11 has an essentially square cross-section on its side away from the bearing surface 2, so that the bearing body 11 can be inserted easily in the area of a flat surface in an open-end spinning device and can be held between two surfaces across from each other due to the square cross-section portion of the design of the bearing body 11.

Figure 3:
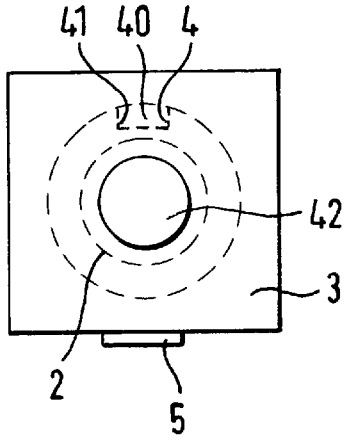
FIG. 3 shows the step bearing of FIG. 1 from the side of its supporting surface.

FIG. 3 shows the bearing body 11 as viewed from the supporting surface 3. The supporting surface 3 has a square base surface reinforced in the center with a pressure-resistant reinforcement 42 in such manner that making the bearing body from plastic does not result in damage of the supporting surface 3 by a force bearing upon it from the machine side. Broken lines in FIG. 3 show the edge of the bearing surface 2 as well as the edges of groove 40.

Figure 4:
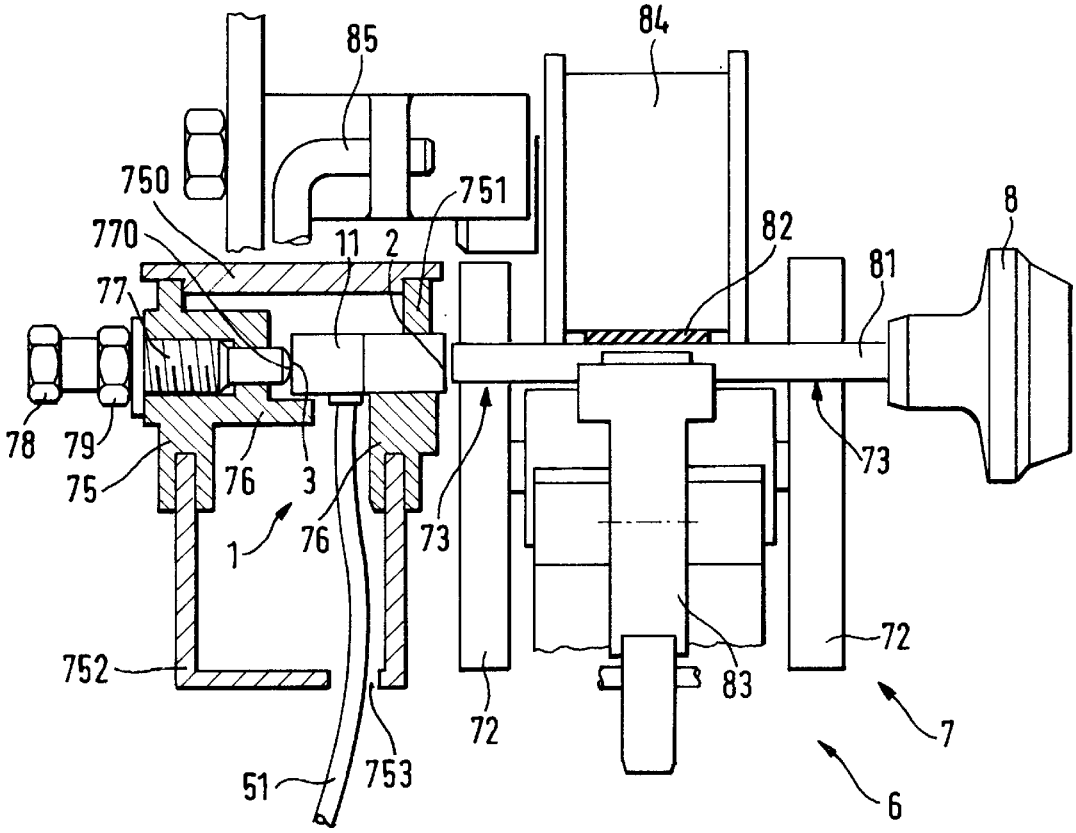
FIG. 4 shows a cross-section through an open-end spinning device with an appertaining axial bearing, whereby the step bearing according to the invention is used in a known open-end spinning device.

FIG. 4 shows a section through an open-end spinning device 6 equipped with the step bearing 1 according to the invention. The open-end spinning device 6 consists essentially of the bearing arrangement 7 of the spinning rotor 8. The bearing arrangement 7 consists of two pairs of supporting disks 72 each forming a nip 73 in which the shaft 81 of the spinning rotor 8 is rotatably supported. The spinning rotor 8 is driven via its shaft 81 by means of a tangential belt 82. To stop the spinning rotor 8, braking means 83 can be applied to the shaft of the spinning rotor 8 so that the shaft 81 together with its spinning rotor 8 come to a stop when necessary. The tangential belt 82 is pressed by means of a pressure roller 84 against the shaft 81, and it can be lifted off again by actuating means 85 for the braking of the shaft 81. In addition to the radial bearing arrangement by means of supporting disks 72, an axial bearing, also designated as step bearing 1 is required for the bearing arrangement 7 of the spinning rotor 8. Because of an inclined position of their axes the supporting disks 72 exert an axial thrust on the spinning rotor 8 supported by the step bearing 1. The step bearing 1 is installed in an axial bearing housing 75 consisting essentially of a supporting element 76 which is in turn attached to the spinning machine (not shown).

The axial bearing housing 75 carries also the support on the machine side in the form of an adjustable element, or as in FIG. 4 an adjusting screw 77, in addition to the bearing body 11 of the step bearing 1. The adjusting screw 77 is provided with outside threads screwing into corresponding counter-threads in the supporting element 76. By turning the screw head 78, the adjusting screw 77 is moved in the direction of the spinning rotor 8 or in the opposite direction, depending on the direction of rotation. In order to set a given position of the adjusting screw 77, a locknut 79, by means of which it is possible to fix the adjusting screw in a known manner is screwed on its threads so that its position is set.

The adjusting screw 77 shown in FIG. 4 is made with a dome-shaped retainer 770 at its end towards the spinning rotor 8 that is also suitable for the support of a ball of an axial ball bearing on the machine side. The dome-shaped retainer 770 does not constitute an even surface so that it is advantageous for the supporting surface 3 to provide a pressure-resistant reinforcement 42 (see FIG. 3) on the bearing body 11. The axial bearing housing 75 has a lid 750 designed to hold the bearing body 11 on the axial bearing housing 75 by means of a projection 751 as in the embodiment of FIG. 4, and also to prevent the loss of lubricant if an axial ball bearing is built into the axial bearing housing 75. In the lower area of the axial bearing housing 75 is a cup-shaped extension 752 making it possible through an opening 753 to supply the step bearing 1 via a compressed-air hose with compressed air. The compressed-air hose 51 is connected to the compressed-air connection 5 (see FIG. 1).

The embodiment of the step bearing 1 according to the invention makes it possible to produce the open-end spinning device 6 with an especially short shaft 81. With otherwise identical dimensions of the rotor bearing arrangement 7, the shaft 81 can be made shorter because the bearing surface 2 can be extended into immediate proximity of the supporting disks 72 towards the axial bearing housing 75. This is achieved by suitable adjustment of the adjusting screw 77. Through this measure it is possible to operate the spinning rotor 8 at higher speeds without having to make any additional changes in the dimensions of the bearing.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A step bearing for use as an axial support of an open-end spinning rotor in a spinning device of an open-end spinning machine, said step bearing comprising:

a bearing body positionable within a bearing housing, said bearing body having a round cross-section portion and an angular cross-section portion;

a flat bearing surface disposed on said round cross-section portion of said bearing body, said bearing surface interactable with a shaft of said spinning rotor;

a support surface disposed on said angular cross-section portion of said bearing body, said support surface interactable with said open-end spinning machine to fixedly hold said bearing body in a position to provide said spinning rotor with axial support; and said bearing body being adjustable within said bearing housing to allow a shortening of said shaft of said spinning rotor without changing the structure of said bearing housing.

2. A step bearing as in claim 1, further comprising a compressed air connection integral to said bearing body perpendicular to an axis of orientation of said spinning rotor, said compressed air connection securable to a supply of compressed air to permit said bearing body to act as an aerostatic bearing.

3. A step bearing as in claim 2, wherein said bearing surface is formed by a bearing plate carried within said round cross-section portion of said bearing body.

4. A step bearing as in claim 3, wherein said bearing surface forms bores through which the passage of compressed air is capable.

5. A step bearing as in claim 3, wherein said bearing plate is non-replaceable and is integral with said bearing body.

6. A step bearing as in claim 3, wherein said bearing plate is pressed into said bearing body.

7. A step bearing as in claim 1, wherein said round cross-section portion of said bearing body forms a groove having support walls which are securable to a mandrel to fixedly hold said bearing body in proper position.

8. A step bearing as in claim 1, wherein said support surface of said angular cross-section of said bearing body is interactable with an adjustable element in said bearing housing to allow axial positioning of said spinning rotor.

9. A step bearing as in claim 8, wherein said bearing body is made of plastic.

10. A step bearing as in claim 9, further comprising a pressure-resistant reinforcement integral to said support surface of said angular cross-section of said bearing body which said support surface is interactable with an adjustable element.

* * * * *